US006439574B1

(12) United States Patent
Robinson

(10) Patent No.: US 6,439,574 B1
(45) Date of Patent: Aug. 27, 2002

(54) METHOD OF PLAYING A POKER GAME USING COMBINED DECKS

(76) Inventor: Mark A. Robinson, 3715 My Way, Las Vegas, NV (US) 89103

( * ) Notice: Subject to any disclaimer, the term of this patent is extended or adjusted under 35 U.S.C. 154(b) by 23 days.

(21) Appl. No.: 09/708,391

(22) Filed: Nov. 9, 2000

(51) Int. Cl.[7] ..... A63F 1/00
(52) U.S. Cl. ..... 273/292; 273/303
(58) Field of Search ..... 273/292, 303–306; 463/12, 13

(56) References Cited

U.S. PATENT DOCUMENTS

| | | | |
|---|---|---|---|
| 5,042,818 | A | 8/1991 | Weingardt |
| 5,356,140 | A | 10/1994 | Dabrowski et al. |
| 5,415,404 | A | 5/1995 | Joshi et al. |
| 5,415,414 | A | 5/1995 | Savage |
| 5,503,401 | A | 4/1996 | Nguyen |
| 5,538,252 | A | 7/1996 | Green |
| 5,540,444 | A | 7/1996 | Nguyen |
| 5,775,992 | A | 7/1998 | Wood et al. |
| 5,997,002 | A | 12/1999 | Goldman |
| 6,007,066 | A | 12/1999 | Moody |
| 6,012,720 | A | 1/2000 | Webb |
| 6,206,375 | B1 * | 3/2001 | Wichinsky |

* cited by examiner

*Primary Examiner*—Benjamin H. Layno
(74) *Attorney, Agent, or Firm*—Ancel W. Lewis, Jr.

(57) ABSTRACT

A method of playing a poker type card game includes combining and randomizing a composite playing deck including selected portions of a standard fifty-two card deck and selected portions of a pinochle deck to change the probability of occurrences of specific hand types from a standard deck. The method is applicable to live poker, electronic video poker games and casino table poker games.

19 Claims, No Drawings

METHOD OF PLAYING A POKER GAME USING COMBINED DECKS

TECHNICAL FIELD

The present invention relates to a card game and more particularly to a poker type card game using a combination of dissimilar decks.

BACKGROUND ART

The usual game of live draw poker uses a conventional or standard fifty-two card deck having the ace through deuce in four suits, hearts, clubs, spades and diamonds. The cards are dealt to a selected number of players and the best hand wins according to the usual poker rules. Electronic video poker machines are a one player game in which the player is competing against a pay table. These two poker-type card games are discussed in U.S. Pat. No. 5,042,118 which is incorporated herein by reference. The casino table poker game has a dealer provided by a house that hosts the game and each player wagers against the dealer. This game is discussed in U.S. Pat. No. 5,415,415 which is also incorporated herein by reference.

Some attempts have been made to provide a poker type card game that adds cards to a standard fifty-two card deck.

Wood et al. U.S. Pat. No. 5,775,992 discloses the use of five standard fifty-two card decks of playing cards shuffled together in a poker type card game.

Goldman U.S. Pat. No. 5,997,002 discloses the use of a standard fifty-two card deck and five additional jokers in a draw poker type card game.

Savage U.S. Pat. No. 5,415,414 discloses a poker type card game using the standard fifty-two card playing deck plus one additional unique card.

Dabrowski et al. U.S. Pat. No. 5,356,140 uses two standard fifty-two card decks which are not shuffled or mixed together but are dealt separately.

DISCLOSURE OF THE INVENTION

The method of play of the game of the present invention involves the combination of at least portions of two dissimilar decks in which preferably a draw poker type game may be played as a live game, an electronic video game, or a casino table game. The addition of at least portions of dissimilar decks changes the probability of occurrence of poker hands that differs from the standard fifty-two card playing deck. The first deck is a portion or a full standard fifty-two card playing deck and the second deck preferably is a portion of or a full pinochle deck.

DETAILED DESCRIPTION

The method of playing a poker type game according to the present invention comprises the steps of combining and randomizing a composite deck of playing cards including a first deck of a portion or all of a standard fifty-two card playing deck and a portion or all of a second deck of playing cards different from the first deck and based on a standard pinochle deck. The cards from the composite deck are distributed as a hand, preferably a five card hand of draw poker, to a selected number of players with each player selecting which, if any, of the cards to discard. A selected additional card or cards are distributed to each of the players desiring additional cards for each player remaining in the game to create a final five card hand for each player remaining in the game.

Each player then evaluates the poker hand using poker hand rankings. In a live poker game the player with the winning hand receives the proceeds of the wagers by the participating players. In a video game or casino game the play is against a gaming device or the dealer, respectively, and there is a pay off to the player according to the winning poker hand. The amount paid the player is based on the player's wager. While reference is made to a five card draw poker game it is understood the present invention is applicable to other poker games such as five or seven card stud.

The first deck while preferably is the full standard deck of ace through deuce of four suits, clubs, hearts, diamonds and spades, it is understood that less than a full standard fifty-two card deck may be used. Three-fourths of a full standard fifty-two card deck would be the ace through deuce of three suits. One-half of a standard deck would be the ace through deuce of two suits. One-fourth of a standard deck would be the ace through deuce of one suit. Another first deck may be removed of one specific rank such as all sixes for a forty-eight card deck.

The second deck while preferably a full pinochle deck of two each of the ace, king, queen, jack, ten and nine of all suits, it is understood that less than a full pinochle deck may be used. The full standard fifty-two card deck and full pinochle deck would total one hundred playing cards. A one-half pinochle deck would be the ace, king, queen, jack, ten, nine of all suits for a total composite deck of seventy-six playing cards. A one-eighth pinochle deck would be the ace, king, queen, jack, ten, nine of one suit for a total of fifty-eight cards. Another fraction of a pinochle deck would be the ace, king, queen, jack, ten of one suit for a total of fifty-seven cards in the composite deck.

It is also understood that the division of the second deck does not have to occur exclusively upon the lines of suit. A one-sixth pinochle deck consisting of all of the queens would total sixty cards in the composite deck. It is further understood that another portion of the second deck could be only four queens, or kings etc. and this would total fifty-six cards.

This combining of at least portions of two different decks changes the probability of occurrence of specific hand types from the probability of occurrence in a standard fifty-two card playing deck while maintaining that the probability of each card is equal.

For example, in a combined deck of fifty-two cards plus the ace, king, queen, jack, ten, nine of hearts (a total of fifty-eight cards), it would be correct to say that the jack of hearts now has two chances in fifty-eight of being dealt. However, the probability of a specific jack of hearts (either the jack of hearts from the standard deck or the jack of hearts from the added cards each having a probability of occurrence of one in fifty-eight) occurring is the same as the probability of any other card in the deck occurring.

Although the present invention has been described with a certain degree of particularity, it is understood that the present disclosure has been made by way of example and that changes in details of structure may be made without departing from the spirit thereof.

What is claimed is:

1. A method of playing a poker-type card game comprising:

combining and randomizing a composite playing deck of playing cards including a first deck of playing cards, said first deck having a full standard deck of 52 playing cards or a portion of a standard deck of 52 playing cards and a second deck of playing cards, said second deck of playing cards having a full 48 card pinochle deck or a portion of a pinochle deck, distributing a hand from said composite playing deck to each of a selected number of players, each player selecting which, if any, of the cards to discard from their hand, distributing an additional card or cards to each of the players desiring additional cards for each player remaining in the game to create a final hand for each player remaining in the game, and each player evaluating the poker hand using conventional poker hand rankings.

2. The method as set forth in claim 1 wherein said first deck is a full standard fifty-two playing cards including the ace through deuce of four suits.

3. The method as set forth in claim 1 wherein said first deck is three-fourths of a standard fifty-two playing cards having three suits.

4. The method as set forth in claim 1 wherein said first deck is one-half of a standard fifty-two card playing deck having two suits.

5. The method as set forth in claim 1 wherein said first deck is one-fourth a standard fifty-two playing cards having one suit.

6. The method as set forth in claim 1 wherein said second deck consists of, for example, only four cards such as queens for a total of fifty-six cards when said decks are combined.

7. The method as set forth in claim 1 wherein the game is played as a live poker game with the player with the winning hand receiving the results of the wagers of the participating players.

8. The method as set forth in claim 1 wherein the game is played on an electronic video game with an electronic display.

9.The method as set forth in claim 1 wherein the game is played as a casino table game having a house dealer, players and player and dealer stations.

10. The method as set forth in claim 1 wherein the process of causing the cards to appear randomly in the video game is accomplished by the use of a pseudo random number generator.

11. The method as set forth in claim 1 wherein the process of causing the cars to appear randomly in a live game or the casino game is accomplished by manually shuffling the deck of cards.

12. A method of playing a poker-type card game comprising:

combining a composite deck of playing cards including a first deck of playing cards, said first deck having a full standard deck of 52 playing cards or a portion of a standard deck of 52 playing cards and second deck of playing cards, said second deck of playing cards having a full 48 card pinochle deck or a portion of a pinochle deck to change the probability of occurrence of specific hand types in the playing hands from the probability of occurrence in a standard fifty-two card playing deck while maintaining that the probability of each individual card is equal, randomizing said composite deck, distributing a hand from said composite playing deck to each of a selected number of players, each player selecting which, if any, of the cards to discard from their hand, distributing an additional card or cards to each of the players desiring additional cards for each player remaining in the game to create a final hand for each player remaining in the game, and each player evaluating the poker hand using conventional poker hand rankings.

13. A method of playing a poker-type card game comprising:

combining a composite playing deck of playing cards including a standard fifty-two playing card deck and a full pinochle deck of playing cards to change the probability of occurrence of specific hand types from the probability of occurrence in a standard fifty-two card playing deck while maintaining that the probability of each individual card is equal, randomizing said composite deck, distributing a five card hand from said composite playing deck to each of a selected number of players, each player selecting which, if any, of the cards to discard from their hand, distributing an additional card or cards to each of the players desiring additional cards for each player remaining in the game to create a final five card hand for each player remaining in the game, and each player evaluating the poker hand using conventional poker hand rankings.

14. A method of playing a poker-type card game comprising:

combining and randomizing a composite playing deck of playing cards including a first deck playing cards, said first deck having a full standard deck of 52 playing cards or a portion of a standard deck of 52 playing cards and a second deck of playing cards, said second deck of playing cards having a full 48 card pinochle deck or a portion of a pinochle deck.

distributing a hand from said composite playing deck to each of a selected number of players, each player selecting which, if any, of the cards to discard from their hand, distributing an additional card or cards to each of the players desiring additional cards for each player remaining in the game to create a final hand for each player remaining in the game, and each player evaluating the poker hand using conventional poker hand rankings, said first deck being minus one rank for a total of forty-eight cards.

15. A method of playing a poker-type card game comprising:

combining and randomizing a composite playing deck of playing cards including a first deck of playing cards, said first deck having a full standard deck of 52 playing cards or a portion of a standard deck of 52 playing cards and a portion of a second deck of playing cards different from said first deck, distributing a hand from said composite playing deck to each of a selected number of players, each player selecting which, if any, of the cards to discard from their hand, distributing an additional card or cards to each of the players desiring additional cards for each player remaining in the game to create a final hand for each player remaining in the game, and each player evaluating the poker hand using conventional poker hand rankings, said second deck being a full forty-eight card pinochle deck having two each of the ace, king, queen, jack, ten and nine of all suits for a total of one hundred cards when said decks are combined.

16. A method of playing a poker-type card game comprising:

combining and randomizing a composite playing deck of playing cards including a first deck of playing cards, said first deck having a full standard deck of 52 playing cards or a portion of a standard deck of 52 playing cards and a portion of a second deck of playing cards different from said first deck.

distributing a hand from said composite playing deck to each of a selected number of players, each player selecting which, if any, of the cards to discard from their hand, distributing an additional card or cards to each of the players desiring additional cards for each player remaining in the game to create a final hand for each player remaining in the game, and each player evaluating the poker hand using conventional poker hand rankings, said second deck being one half of a full forty-eight card pinochle deck having the ace, king, queen, jack, ten and nine of each suit for a total of seventy-six cards when said decks are combined.

17. A method of playing a poker-type card game comprising:

combining and randomizing a composite playing deck of playing cards including a first deck playing cards, said first deck having a full standard deck of 52 playing cards or a portion of a standard deck of 52 playing cards and a portion of a second deck of playing cards different from said first deck, distributing a hand from said composite playing deck to each of a selected number of players, each player selecting which, if any, of the cards to discard from their hand, distributing an additional card or cards to each of the players desiring additional cards for each player remaining in the game to create a final hand for each player remaining in the game, and each player evaluating the poker hand using conventional poker hand rankings, said second deck being one-eighth of a full forty-eight card pinochle deck having the ace, king, queen, jack, ten and nine of one suit for a total of fifty-eight cards when said decks are combined.

18. A method of playing a poker-type card game comprising:

combining and randomizing a composite playing deck of playing cards including a first deck of playing cards, said first deck having a full standard deck of 52 playing cards or a portion of a standard deck of 52 playing card and a portion of a second deck of playing cards different from said first deck, distributing a hand from said composite playing deck to each of a selected number of players, each player selecting which, if any, of the cards to discard from their hand, distributing an additional card or cards to each of the players desiring additional cards for each player remaining in the game to create a final hand for each player remaining in the game, and each player evaluating the poker hand using conventional poker hand rankings, said second deck being one card less than one-eighth of a forty-eight card pinochle deck having the ace, king, queen, jack and ten of one suit for a total of fifty-seven cards when said decks are combined.

19. A method of playing a poker-type card game comprising:

combining and randomizing a composite playing deck of playing cards including a first deck playing cards, said first deck having a full standard deck of 52 playing cards or a portion of a standard deck of 52 playing card and a portion of a second deck of playing cards different from said first deck, distributing a hand from said composite playing deck to each of a selected number of players, each player selecting which, if any, of the cards to discard from their hand, distributing an additional card or cards to each of the players desiring additional cards for each player remaining in the game to create a final hand for each player remaining in the game, and each player evaluating the poker hand using conventional poker hand rankings, said second deck being one-sixth of a forty-eight card pinochle deck including, for example, all queens for a total of sixty cards when said decks are combined.

* * * * *